US009096944B2

(12) United States Patent
Slagle et al.

(10) Patent No.: US 9,096,944 B2
(45) Date of Patent: Aug. 4, 2015

(54) AIR DISTRIBUTION SYSTEM FOR ANODIZING TANK

(75) Inventors: James Slagle, Pflugerville, TX (US); Xue Ming Lu, JiangSu Province (CN)

(73) Assignee: Dell Products L.P., Round Rock, TX (US)

( * ) Notice: Subject to any disclaimer, the term of this patent is extended or adjusted under 35 U.S.C. 154(b) by 432 days.

(21) Appl. No.: 13/470,526

(22) Filed: May 14, 2012

(65) Prior Publication Data

US 2013/0299358 A1 Nov. 14, 2013

(51) Int. Cl.

| | |
|---|---|
| ***C25D 21/10*** | (2006.01) |
| ***C25D 11/02*** | (2006.01) |
| ***C25D 21/12*** | (2006.01) |
| ***C25D 11/00*** | (2006.01) |

(52) U.S. Cl.

CPC ..... *C25D 21/10* (2013.01); *C25D 11/005* (2013.01); *C25D 11/02* (2013.01); *C25D 21/12* (2013.01)

(58) Field of Classification Search

USPC ..... 366/107

See application file for complete search history.

(56) References Cited

U.S. PATENT DOCUMENTS

| | | | | |
|---|---|---|---|---|
| 3,081,239 | A * | 3/1963 | Clauss et al. | 366/107 |
| 3,411,994 | A | 11/1968 | Wainer | |
| 3,622,132 | A * | 11/1971 | Rawlings, Jr. | 261/124 |
| 3,708,407 | A * | 1/1973 | Newman et al. | 205/108 |
| 3,738,628 | A * | 6/1973 | Nechine | 261/122.1 |
| 3,809,317 | A * | 5/1974 | Bender | 239/251 |
| 3,959,112 | A * | 5/1976 | Arend, Jr. | 204/273 |
| 4,026,781 | A * | 5/1977 | Newman et al. | 204/229.2 |
| 4,174,261 | A * | 11/1979 | Pellegrino | 204/273 |
| 4,512,665 | A * | 4/1985 | Cline et al. | 366/173.2 |
| 4,960,546 | A * | 10/1990 | Tharp | 261/122.1 |
| 5,110,512 | A * | 5/1992 | Kwon | 261/122.1 |
| 5,863,472 | A * | 1/1999 | Jones | 261/124 |
| 6,849,172 | B2 * | 2/2005 | Rigby et al. | 205/101 |
| 6,852,266 | B2 | 2/2005 | Robinson et al. | |
| 8,505,885 | B2 * | 8/2013 | Hildebrand et al. | 261/122.1 |
| 2010/0065433 | A1 * | 3/2010 | Heiremans | 205/148 |

OTHER PUBLICATIONS

Fred C. Schaedel, Try a Holistic Approach to Improve Anodizing Processes, Products Finishing Magazine, Dec. 1, 2006.

* cited by examiner

*Primary Examiner* — Harry D Wilkins, III

(74) *Attorney, Agent, or Firm* — Terrile, Cannatti, Chambers & Holland, LLP; Robert W. Holland

(57) ABSTRACT

Information handling system metal housing portions, such as aluminum portions, are anodized in an electrolyte bath agitated by a balanced air deliver system that reduces dead zones for improved chemical distribution and consistent temperatures at the metal housing portion. Equal-sized air distribution portions selectively couple to an air distribution portion to provide an air distribution system with balanced air delivery.

11 Claims, 2 Drawing Sheets

AIR DISTRIBUTION SYSTEM FOR ANODIZING TANK

BACKGROUND OF THE INVENTION

1. Field of the Invention

The present invention relates in general to the field of information handling system manufacture, and more particularly to information handling system anodized housing manufacture.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems often include sensitive components that are enclosed in a metallic housing. Aluminum is one example of a metal having characteristics that provide an acceptable solution for an information handling system housing. Aluminum has good strength with relatively light weight to help reduce the overall size and weight of an information handling system. Reduced size and weight are especially desirable characteristics for portable information handling systems, such as laptops, tablets and smartphones.

One difficulty with aluminum is that it oxidizes when exposed to the atmosphere. Oxidation of untreated aluminum by exposure to the atmosphere detracts from the appearance of the metal and makes the metal susceptible to physical damage and further decay over time. In order to protect aluminum and similar metals (such as magnesium, titanium, zinc, niobium and tantalum) from oxidation, the outer surface is typically passivated so that underlying metal will not oxidize. One common technique for passivation of aluminum and similar metals is anodizing the metal with electrolytic passivation to increase the thickness of the natural oxidation layer on the surface of the metal. The aluminum is the anode electrode in an electrically charged bath so that oxygen released by hydrolysis in the presence of an electrical charge forms aluminum oxide with micro-crystalline structures having shorter and more stable bonds.

Typical anodizing processes involve preliminary steps to clean the metal surface and chemically polish the surface, such as by soaking in a solvent bath to remove grease followed by soaking in a solvent bath to etch the metal. The prepared metal is then submerged in an electrolytic solution and exposed to an electric current with the metal acting as the anode of the current. Various types of anodizing aluminum use different types of electrolytic solutions, such as chromic acid type I anodizing or sulfuric acid type II and III anodizing. Anodizing of other metals use these and other electrolytic solutions. Once a desired oxidation layer thickness is formed on the aluminum surface, the surface is protected by dyeing and then sealing nano-pores formed during anodizing.

During the anodizing process, the bath that holds the metal is typically agitated with an airflow from a tube that has holes to allow air to pass into the bath. The air agitates the bath to help ensure that the metal has a consistent bath content across its surface. If an uneven bath content flows over the surface of the metal, the cosmetics of the final metal product can have inconsistencies, such as poor dye color distribution evidenced when mottling and uneven anodized thickness are present. Poor cosmetics of the final metal product due to an inconsistent bath content can be amplified by other process imperfections, such as residual internal stress from metal stamping, inconsistent sanding or polishing, uneven bead blasting or other mechanical steps that adversely affect the surface prior to anodizing.

SUMMARY OF THE INVENTION

Therefore a need has arisen for a system and method which anodizes metal in a consistent bath that provides improved cosmetics of the metal end product, such as an information handling system.

In accordance with the present invention, a system and method are provided which substantially reduce the disadvantages and problems associated with previous methods and systems for agitating an anodizing bath. An air distribution system assembles in one or more baths of an anodizing process to distribute air in a balanced manner for agitating the bath. A balanced air distribution is obtained by disposing substantially identical air distribution portions symmetrically about an anodizing location where a metal component is placed for treatment so that the symmetrical placement of the air distribution portions provides a symmetrical agitation pattern.

More specifically, an anodizing process has plural tanks to degrease, chemically polish, anodize, dye and seal a metal component, such as an aluminum information handling system housing component. An air source provides pressurized air to one or more of the tanks to agitate the fluid in the tank for improved chemical and thermal energy distribution. Balanced air agitation is provided by an air distribution system that assembles within one or more of the tanks. The air distribution system includes an air source portion having an inlet to accept pressurized air and plural outlets that provide the pressurized air to air distribution portions. A coupling point at each outlet of the air source portion couples an air distribution portion to accept the pressurized air. The coupling points are disposed substantially equidistance to an anodizing location where the metal piece is treated and the distribution portions are substantially similar in length, size and distribution of openings so that the assembled air distribution system provides a balanced agitation about the anodizing location.

The present invention provides a number of important technical advantages. One example of an important technical advantage is that improved agitation of an anodizing bath provides a more consistent cosmetic finish for metal treated in the anodizing bath, such as aluminum. Dead zones in the anodizing bath are reduced by distributing air for agitation in a more even fashion throughout the bath so that chemicals of the bath are more evenly distributed and a more consistent temperature is realized throughout the bath. Reduced numbers of dead zones help to de-emphasize the impact of imperfections introduced during mechanical processes that precede anodizing. Improved agitation provides a cosmetically pleasing final product with reduced mottling, more even surface texture, reduced surface variations, improved dye color distribution and more even anodized thickness. Improved agitation improves process yields with fewer scrap parts and reduced manufacture costs. Configurable air distribution adjusts to the dimensions of an anodizing bath tank by altering the length and location of air distribution devices disposed in the anodizing bath tank. Motion added to distribution devices further prevents the introduction of dead zones by moving or vibrating the openings of the air distribution devices within the anodizing tank.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Balanced air agitation within an anodizing tank reduces dead zones to provide improved quality for information handling system housing portions. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of non-volatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
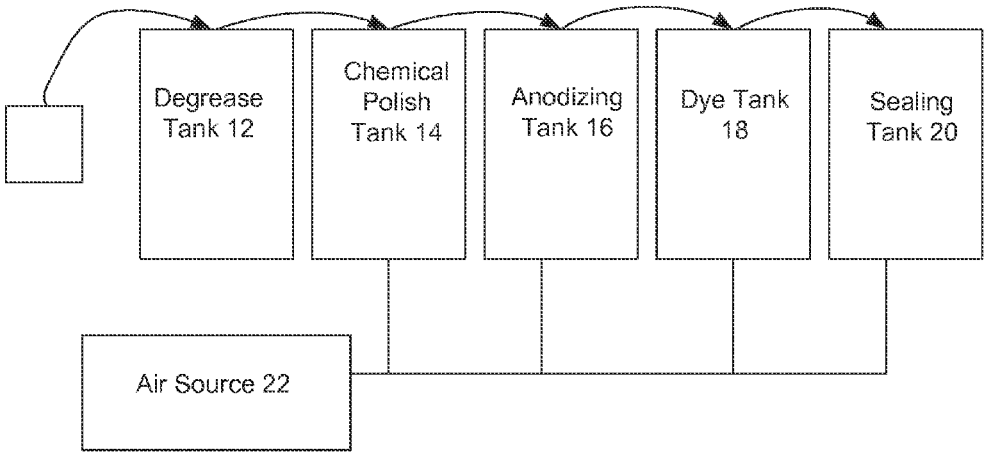
FIG. 1 depicts a block diagram of an anodizing process for anodizing an information handling system housing metal portion.

Referring now to FIG. 1, a block diagram depicts an anodizing process for anodizing an information handling system housing metal portion 10. Metal portion 10 is first cleansed by soaking in a degrease tank 12 that has a cleaning solvent. The cleaned metal portion 10 is then placed in a chemical polish tank 14 to etch the outer surface of the metal. After chemical polishing, the metal portion 10 is placed in an anodizing tank 16 that has an electrolyte bath and a current source for promoting oxidation of the metal portion 10 outer surface. The particular chemicals used to degrease, polish and anodize metal portion 10 may vary dependent upon the type of metal being processed and the type of oxidation desired for the outer surface. In one example embodiment, an aluminum information handling system housing portion 10 is anodized with a Type II process that has a sulfuric acid electrolyte bath in anodizing tank 16. After completion of oxidation in anodizing tank 16, the metal portion 10 is placed in a dye tank 18 to color the outer surface and a sealing tank 20 to seal the outer surface. During the chemical polish, anodizing, dye and sealing processes, an air source 22 provides air to each tank so that the fluid in each tank is agitated. Agitation of the fluid promotes more even distribution of active chemicals near the surface of the metal portion and also promotes an even temperature at the surface of the metal portion. A balanced agitation throughout each tank prevents the formation of dead zones that can produce and/or intensify imperfections on the metal surface.

Figure 2:
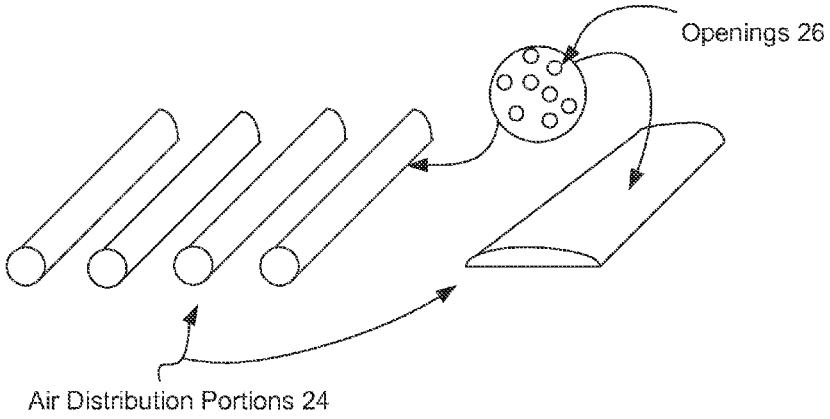
FIG. 2 depicts air distribution portions that assemble to form an air distribution system to agitate an anodizing tank.

Referring now to FIG. 2, air distribution portions 24 are depicted that assemble to form an air distribution system to agitate an anodizing tank. In the example embodiment depicted by FIG. 2, each air distribution portion 24 has a substantially similar length, diameter and pattern of openings 26 so that symmetric assembly of the air distribution portions 24 within an anodizing tank will provide symmetric air agitation throughout the anodizing tank. In alternative embodiments, variations in the size and pattern of openings of air distribution portions 24 may be used to create variations in agitation patterns. Air distribution portions 24 couple to an air source portion to receive air from air source 22 and distribute the air through openings 26. A plurality of openings 26 formed in each air distribution portion 24 that have substantially the same size and spacing promote even agitation by introducing small bubbles to the fluid. Air distribution portions 24 can have openings formed in a round pipe or can have other shapes, such as a flat or oval surface with openings along an upper surface to release air bubble across a greater surface area. By having substantially similar shapes, lengths and opening patterns, air distribution portions 24 provide a symmetrical distribution of air bubbles when disposed in a tank in a symmetrical manner. In one embodiment, multiple sets of air distribution portion 24 sets are provided with each set having a similar shape, length and opening pattern so that air distribution portions may be assembled to each other. For example, fewer openings may be included in an air distribution portion set that couples to an air source portion compared with a second set that couples to the first set. Greater numbers of openings in the second set will provide a similar air distribution volume across the assembled first and second set distribution portions by compensating for any drop in pressure that occurs as the distance from the air source 22 increases.

Figure 3:
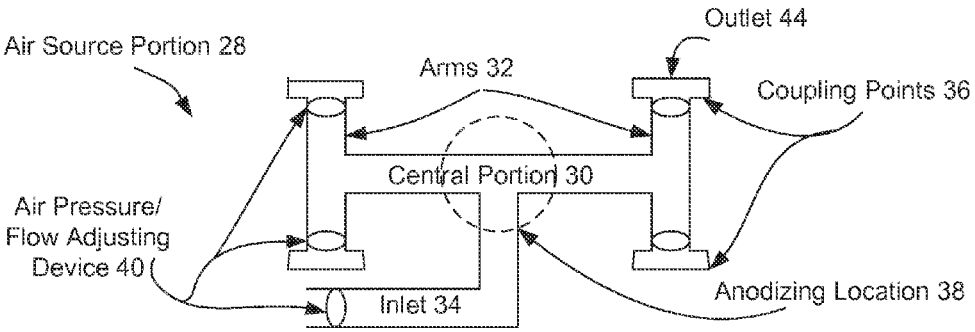
FIG. 3 depicts an air source portion that supports air distribution portions within an anodizing tank.

Referring now to FIG. 3, an air source portion 28 is depicted that supports air distribution portions 24 within an anodizing tank. Air source portion 28 has an I-shape with a central portion 30 and first and second arms 32 coupled perpendicular to each end of central portion 30. Pressurized air enters central portion 30 through an inlet 34 and flows to a coupling point 36 located at the end of each arm 32. In one embodiment, air source portion 28 includes openings 26 to release air into the tank; alternatively, air source portion 28 is a solid material that does not include openings to release air. Air source portion 28 rests in the bottom of an anodizing tank underneath the anodizing location 38 at which a material subject to anodizing is placed. A centrally-placed air source portion 28 having openings to release air provides agitation concentrated at the location of the material and offers a reference point around which air distribution portions 24 may be placed to obtain balanced agitation throughout the anodizing tank. Each coupling point 36 is placed substantially equidistance from the center of anodizing location 38 so that substantially-identical air distribution portions 24 coupled to each coupling point 36 will provide a balance agitation around anodizing location 38. Air pressure adjusting devices 40 located at inlet 34 and each coupling point 36 adjust the flow of air by, for instance, regulating pressure or adjusting the size of the air passage to provide an operator of the anodizing tank with an opportunity to adjust agitation within the anodizing tank.

Figure 4:
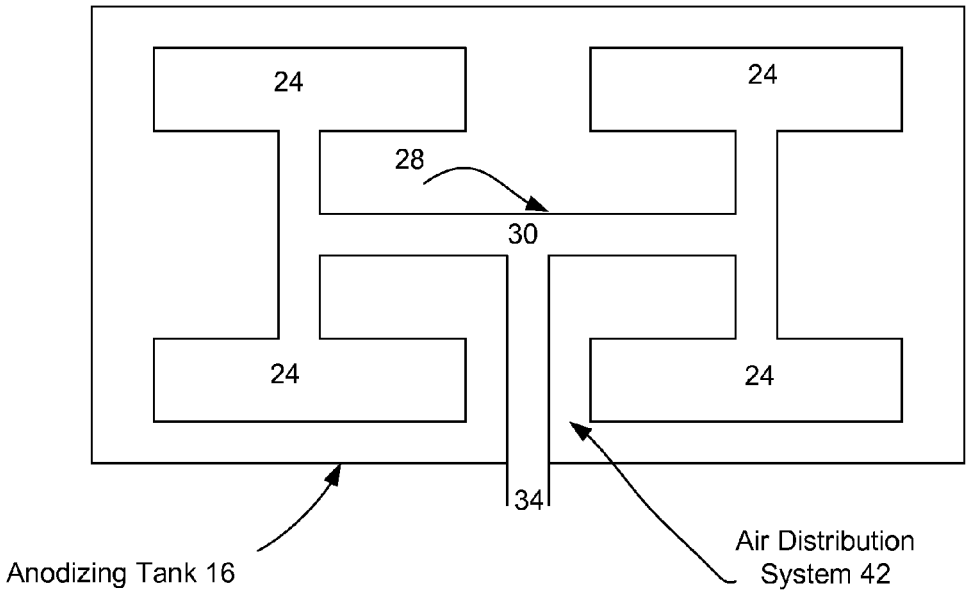
FIG. 4 depicts a top view of one embodiment of the air distribution system disposed in an anodizing tank.

Referring now to FIG. 4, a top view depicts one embodiment of the air distribution system 42 disposed in an anodizing tank 16. Air source portion 28 has an air distribution portion 24 coupled at each coupling point 36 of opposing ends of each arm 32 where an outlet 44 provides pressurized air through the coupling point to the air distribution portion 24. Coupling points 36 pass air from air source portion 28 to air distribution portions 24, which pass the air into the fluid of the anodizing tank. An operator can readily assemble air distribution portions 24 into a balanced air distribution system 42 since each air distribution portion 24 has substantially the same size and opening configurations disposed equidistant to the anodizing location 38. In alternative embodiments, multiple air distribution portions 24 can couple to each coupling point 36 with a balanced disposition by reference to common size and opening configurations for each set of air distribution portions. Adjustable air pressure and air flow settings by one or more air pressure adjustment devices 40 further control the balanced agitation provided by equally-sized air distribution portions 24. Evenly branched air distribution portions 24 will have similar air distribution characteristics with a visual reference available for a balance assembly through symmetrical disposition of like branches. Air distribution system 42 provides balanced agitation in each of the chemical polish tank 14, anodizing tank 16, dye tank 18 and sealing tank 20. In alternative embodiments, coupling points 36 have hinged connections so that the axis along which air distribution portions 24 align is adjustable for further balancing of agitation in the tank. Although reference is made to use of the air distribution system 42 in an anodizing tank 16 around an anodizing location 38, air distribution system 42 may be used in any tank of the anodizing process about any location where a component is processed.

Figure 5:
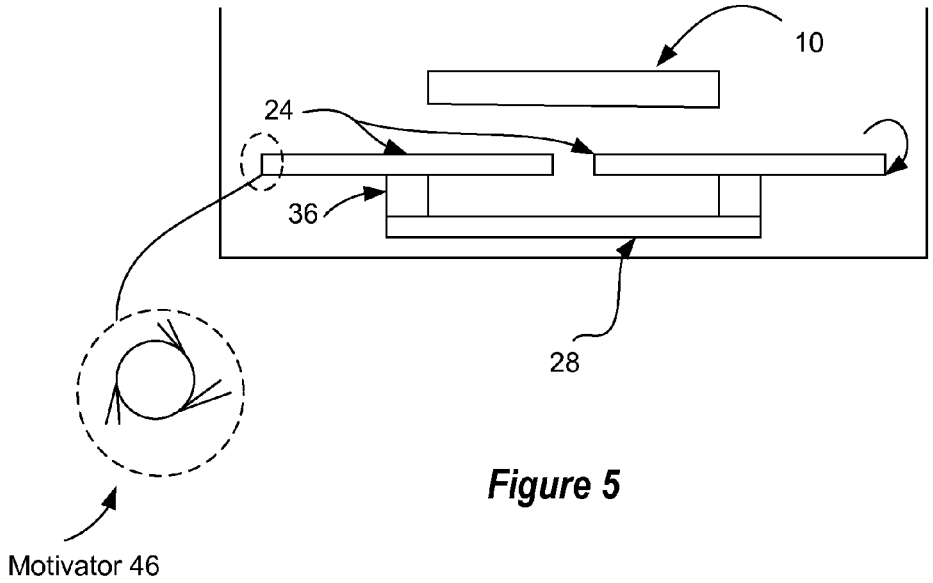
FIG. 5 depicts a side view of another embodiment of the air distribution system disposed in an anodizing tank.

Referring now to FIG. 5, a side view of another embodiment of the air distribution system 42 disposed in an anodizing tank 16. Air distribution portions 24 assemble to coupling points 36 to rotate about a longitudinal axis with a motivator 46 translating air pressure into rotational movement. Rotation of air distribution portion 24 further aids a balanced agitation by encouraging release of air from air distribution portion 24 in multiple directions. In one embodiment, motivator 46 is an angled opening formed on opposing ends of air distribution portions 24 that induces rotation of the air distribution portion. In alternative embodiments, motivator 46 may induce motion at other locations with the air distribution system, such as with vibration at air source portion 28 to encourage release of air bubbles from openings formed in air source portion 28.

Figure 6:
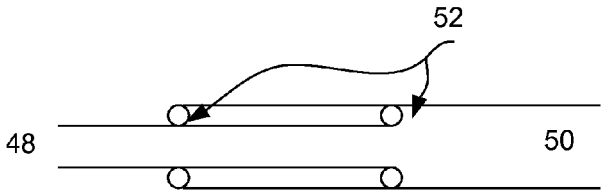
FIG. 6 depicts a side view of one embodiment of an air source portion having adjustable length.

Referring now to FIG. 6, a side view depicts one embodiment of an air source portion 28 having an adjustable length to aid in obtaining balanced air agitation by adjusting the location of air distribution portions 24 that couple to it. In the example embodiment, a first pipe 48 has a smaller diameter than a second pipe 50 to allow the first pipe 48 to slide within the second pipe 50 to establish a variable length. A seal 52 allow sliding motion while limiting or preventing fluid from the tank entering the pipes. In alternative embodiments, alternative types of extension systems may be used to alter the length of air source portion 28 or an air distribution portion 24.

Although the present invention has been described in detail, it should be understood that various changes, substitutions and alterations can be made hereto without departing from the spirit and scope of the invention as defined by the appended claims.

What is claimed is:

1. A system for distributing air in an anodizing tank electrolyte bath, the system comprising:

an anodizing tank filled with anodizing liquid to provide an electrolyte bath to a material placed in the electrolyte bath for anodizing treatment;

an air source portion having an inlet to accept pressurized air and plural coupling points to provide the pressurized air to plural air distribution portions; and plural air distribution portions operable to couple to the coupling points of the air source portion, the air distribution portions having plural openings to pass air into the electrolytic bath of the anodizing tank;

wherein the air source portion adjusts the coupling points to plural positions to move each of the plural air distribution portions to plural positions within the anodizing bath.

2. The system of claim 1 wherein each of the plural air distribution portions comprises an air pipe having substantially equal length.

3. The system of claim 2 wherein each air pipe has plural substantially equal-sized openings.

4. The system of claim 3 wherein each coupling point further comprises an air pressure adjustment device to adjust the amount of air provided from the air source portion to the air distribution portion coupled to each coupling point.

5. The system of claim 1 further comprising a motivator operable to translate energy provided by pressurized air of the air source portion into movement of the air distribution portions.

6. The system of claim 5 wherein the motivator comprises openings angled in each of the air distribution portions to cause the air distribution portion to spin.

7. The system of claim 5 wherein the motivator comprises openings angled in the air source portion to translate motion of the air source portion into motion of the air distribution portions.

8. An air distribution system comprising:

an anodizing tank;

electrolyte disposed in the anodizing tank to provide an electrolyte bath that anodizes a metal part;

an air source portion sized to fit in the anodizing tank and having an inlet to accept pressurized air and plural coupling points, each coupling point adapted to couple to an air distribution portion; and plural air distribution portions, each air distribution portion operable to couple to a coupling point to accept pressurized air, each air distribution portion having plural openings to pass air into the anodizing tank;

wherein the plural air distribution portions have adjustable positions to within the anodizing tank to adapt air distribution to the anodizing tank.

9. The air distribution system of claim 8 wherein each air distribution portion has a substantially equal size and substantially similar distribution of the plural openings.

10. The air distribution system of claim 9 further comprising coupling point adapters operable to couple air distribution portions to each other.

11. The air distribution system of claim 8 further comprising a motivator operable to couple to an air distribution portion to translate air pressure into motion of the air distribution portion.

* * * * *